US006811589B2

(12) United States Patent
Kelly

(10) Patent No.: US 6,811,589 B2
(45) Date of Patent: Nov. 2, 2004

(54) METHOD FOR ADDING SOLID ZINC-ALUMINUM TO GALVANIZING BATHS

(75) Inventor: Paul Allan Kelly, New Kensington, PA (US)

(73) Assignee: Specialty Minerals Michigan Inc.

( * ) Notice: Subject to any disclaimer, the term of this patent is extended or adjusted under 35 U.S.C. 154(b) by 0 days.

(21) Appl. No.: 10/314,824

(22) Filed: Dec. 9, 2002

(65) Prior Publication Data

US 2004/0110025 A1 Jun. 10, 2004

(51) Int. Cl.[7] ..... C22B 19/20; C22B 21/00; B05D 1/18

(52) U.S. Cl. ..... 75/663; 427/433; 75/684; 75/671; 75/686

(58) Field of Search ..... 75/671, 672, 684, 75/686, 303, 304, 313, 315, 324, 654, 655, 663, 433; 427/433, 435, 434.6, 436; 420/540, 514, 528

(56) References Cited

U.S. PATENT DOCUMENTS

| | | | | | |
|---|---|---|---|---|---|
| 2,595,292 | A | * | 5/1952 | Reece | 75/122 |
| 3,227,577 | A | * | 1/1966 | Baessler et al. | 117/102 |
| 3,634,075 | A | * | 1/1972 | Hoff | 75/135 |
| 3,729,309 | A | * | 4/1973 | Kawawa | 420/126 |
| 3,738,827 | A | | 6/1973 | Pryor et al. | 75/76 |
| 4,088,475 | A | | 5/1978 | Tyler et al. | 75/153 |
| 4,330,328 | A | | 5/1982 | Tyler et al. | 75/76 |
| 4,481,032 | A | | 11/1984 | Kaiser | 75/58 |
| 4,512,800 | A | | 4/1985 | Wirth, Jr. | 75/53 |
| 4,688,771 | A | * | 8/1987 | Eckert et al. | 266/78 |
| 5,026,433 | A | | 6/1991 | Vierod et al. | 148/2 |
| 5,076,548 | A | * | 12/1991 | Arndt et al. | 266/44 |
| 5,321,792 | A | * | 6/1994 | Schonherr et al. | 392/388 |
| 5,827,576 | A | | 10/1998 | Carter et al. | 427/436 |
| 5,998,545 | A | | 12/1999 | King | 242/178 |
| 6,053,960 | A | | 4/2000 | King et al. | 75/375 |
| 6,280,497 | B1 | | 8/2001 | King et al. | 75/304 |
| 6,426,122 | B1 | | 7/2002 | Ishii et al. | 427/433 |

OTHER PUBLICATIONS

V. Neufeldt, ed., "Webster's New World Dictionary," Webster's New World, New York (1988, no month), p. 553.*

* cited by examiner

*Primary Examiner*—Michael La Villa
(74) *Attorney, Agent, or Firm*—Marvin J. Powell; Michael J. Herman

(57) ABSTRACT

The process of the present invention is directed to a method for making zinc or zinc-aluminum alloy additions to galvanizing baths. The process involves addition of a wire of zinc or zinc-aluminum alloy introduced directly into a molten galvanizing bath to more rapidly achieve a desired zinc or zinc-aluminum chemistry thereby reducing the time required to make the bath addition.

9 Claims, No Drawings

METHOD FOR ADDING SOLID ZINC-ALUMINUM TO GALVANIZING BATHS

FIELD OF THE INVENTION

The present invention relates to a method for adding solid zinc or zinc-aluminum to galvanizing baths.

BACKGROUND OF THE INVENTION

Ferrous materials are widely used in building structures and other components such as fasteners and automotive parts. Since they are readily corroded, various means have been employed to protect them from corrosion. Among these means, hot dip zinc plating or galvanizing is applied to a wide variety of ferrous materials ranging from small-sized joint members such as bolts to large-sized structural members such as "I"-shaped steel beams to wire and sheet products such as wire coil and automobile parts.

In general, galvanizing of iron and iron-based alloys is carried out in a galvanizing tank containing a molten bath of zinc metal by either a batch or continuous process. Typically, a batch process is used to galvanize discrete parts by dipping them into the bath while a continuous process is used to galvanize wire or sheet product by passing it into and out of the bath using rollers.

A problem that arises in hot galvanizing coating processes is the formation of impurities, known as "dross," on the exposed surface of and in the molten coating bath. It is desirable to minimize the extent to which the dross is capable of contacting the surface of ferrous metal and ferrous based alloy parts as they enter and exit the molten coating bath. There are various forms of dross that can be present in the molten coating bath. One type of dross is caused by the oxidization of the coating metal or alloy. Another type of dross is due to the formation of intermetallic compounds between the zinc or other metal constituent in the bath with iron that is dissolved from the surface being galvanized or that may otherwise be carried into the bath (e.g., iron fines). These compounds form insoluble particles that are denser than the molten bath and settle to the bottom of the galvanizing vessel containing the bath. As a result, an undesirable sludge forms that can be entrained in the molten metal of the coating. Both types of dross reduce the quality of the coating, a problem that is particularly deleterious in applications requiring high surface finishes, e.g., automotive sheet steel. Thus, prior art galvanizing processes have attempted to inhibit the formation of dross in or remove dross formed from molten galvanizing baths.

In conventional hot dip coating processes, this has been mechanically accomplished by employing relatively elaborate devices that circulate the dross to prevent it from accumulating at locations where the dross could undergo substantial contact with the ferrous-containing part or stock entering or exiting the molten coating bath. It is also known that a specified amount of aluminum is added to adjust the chemistries of the molten galvanizing bath. This is typically accomplished by adding zinc or zinc-aluminum alloy ingots or bars that are approximately 2 inches by 3 inches by 24 inches in dimension and weigh approximately 40–50 pounds each. The composition of these ingots is typically that provided for in ASTM B860-95 Standard Specification for Zinc Master Alloys for Use in Hot Dip Galvanizing, which specifies zinc master alloys including zinc or zinc-aluminum brighteners used in hot dip galvanizing for the purpose of adjusting the concentration of alloying elements in the molten zinc bath. Typically, 90/10 Zn/Al High Purity alloy ingots containing between about 10 to about 13 percent aluminum are used to lower the melting point of the ingots to facilitate the melting and incorporation of the zinc or zinc-aluminum alloy addition into the bath. However, this method of addition generally requires about 16 hours to make a 5000 pounds alloy addition of ingots to a molten galvanizing bath.

RELATED ART

U.S. Pat. No. 6,426,122 discloses a method for hot dip galvanizing comprising the steps of dividing a plating vessel holding a molten metal into a plating tank and a dross removing tank; conducting hot dip galvanizing to a steel strip by immersing it in the molten metal bath; then transferring the molten metal bath from the plating tank to the dross removing tank; removing a dross from the molten metal bath in the dross removing tank; and recycling the molten metal bath from the dross removing tank to the plating tank through an opening located on the plating tank. The apparatus for galvanizing comprises a plating tank, a dross removing tank, a means to transfer the molten metal bath from the plating tank to the dross removing tank, and an opening located on the plating tank to recycle the molten metal bath from the dross removing tank to the plating tank.

U.S. Pat. No. 5,827,576 discloses a hot dip coating apparatus and method for coating a continuous steel strip, wire, or like continuous member with zinc, aluminum, tin, lead, or alloys of each. A molten coating bath is contained in a vessel having a bottom opening upwardly through which the steel member is directed. Magnetic containment devices located below the vessel's bottom opening prevent the escape of molten metal from the vessel through the opening. The molten coating metal bath can be replenished by metal from a wire drawn from a spool of wire. The wire may be fed or directed downwardly by guide rolls through a vertically disposed induction heating coil, located directly above vessel, for heating the wire to a desired temperature, or its melting point. As the wire is fed downwardly through the heating coil, the wire is melted.

U.S. Pat. No. 5,026,433 discloses a method of producing a grain refined copper base alloy. The alloy contains iron in the amount of less than 2.3% by weight and is cast into an ingot by conventional direct chill casting. Calcium is added to the melt before casting, preferably in the form of a copper-clad or iron-clad calcium feedwire.

U.S. Pat. No. 4,512,800 discloses an apparatus for adding wire-form processing elements directly into a molten material, particularly the addition of calcium to iron and steel in the molten state. The apparatus comprises a heat resistant nozzle positionable relative to the surface of the molten material such that an inlet is disposed above the surface and an outlet is disposed beneath the surface. A mechanism for feeding the wire through the nozzle directly into the molten material and a system for injecting a substantially inert gaseous medium into the molten material together with the wire are provided. The inert gas is reported to substantially prevent closure of the nozzle by solidified molten material and promote mixture of the processing elements with the molten material through gas bubble agitation.

U.S. Pat. No. 4,481,032 discloses a process for adding calcium to a bath of molten ferrous material in which a calcium metal-containing wire is fed through a refractory lance into the bath. Recirculatory stirring of the molten ferrous material is accomplished with an inert gas flow through the lance. The calcium-containing wire is fed at such a rate that it substantially bends towards the horizontal direction after it leaves the lance and melting of the calcium in the wire occurs primarily in or directly below a region of downwelling of the molten ferrous material. Suitable wire feeding rates are reported to depend upon the disposition of the lance in the bath and the composition (e.g., clad or unclad) and cross-sectional dimensions of the calcium metal-containing wire.

U.S. Pat. No. 4,330,328 discloses a process and apparatus for producing a copper metal or alloy wherein a first material is added to a molten metal, consisting essentially of copper preferably in a furnace. After the first material is added, the molten metal is passed through a filtration device to remove particulate matter from the molten metal and/or reduce the oxygen content of the molten metal. After filtration, a second material addition preferably comprising a zirconium material is made. The zirconium material is added to the melt preferably in powder form by wire-feed apparatus. Although in the preferred embodiment the process is used to make a copper alloy, it is alleged that the process can also be used to make alloys having other base metals, i.e., aluminum.

U.S. Pat. No. 4,088,475 discloses a method for adding reactive elements to molten copper or copper base alloys. The method prevents unwanted reactions and oxidation by adding the reactive elements to the molten metal in the form of a powder mixture placed within tubing that is compatible with the molten metal. The filled tubing is sealed and drawn down, if desired, to an appropriate size for reportedly rapid melting within the molten metal and consequent rapid dissolution of the reactive elements throughout the molten metal.

U.S. Pat. No. 3,738,827 discloses a method for adding solid metal to molten metal, allegedly without deleterious reaction with air. The method is characterized by providing the solid metal in rod or wire form clad with a material compatible with the molten metal and feeding the clad material into the molten metal. The method is reportedly particularly useful in deoxidizing molten metal, especially copper base alloys with a metal of the lanthanide series.

The foregoing illustrates limitations known to exist in present galvanizing plating baths and their preparation methods. Thus it is apparent that it would be advantageous to provide an alternative directed to overcoming one or more of the limitations set forth above. Accordingly an alternative method for adding solid zinc or zinc-aluminum to galvanizing baths is provided including the features more fully disclosed hereinafter.

SUMMARY OF THE INVENTION

The present invention relates to a method for adding solid zinc or zinc-aluminum to galvanizing baths is provided. This method includes providing a molten mass of metal selected from the group consisting of zinc, aluminum, zinc-based alloys, or aluminum-based alloys; providing a zinc or zinc-aluminum based alloy wire; and adding the wire into the molten metal mass to enable dissolution and uniform distribution of the zinc or zinc-aluminum based alloy throughout the entire molten metal mass.

DETAILED DESCRIPTION OF THE INVENTION

As used herein, the terms "wire" or "rod" are used interchangeably and mean a solid single continuous strand of material having a cross section from about 5 to about 25 millimeters (mm). This could also include rectangular, trapezoidal, or other geometrical configurations.

The process of the present invention is directed to a method for making zinc or zinc-aluminum alloy additions to galvanizing baths alleviates problems heretofore presented by previously known processes. In the process of the present invention, rod or wire of zinc or zinc-aluminum alloy is introduced directly into a molten galvanizing bath to rapidly achieve a desired zinc or zinc-aluminum chemistry thereby reducing the time required to make the bath addition. Moreover, by introducing zinc or zinc-aluminum rod or wire into a molten galvanizing bath, such additions can be fed deeper into the molten metal before melting, thereby minimizing dross formation.

The rod or wire that is useful in the method of the present invention may be formed by extruding, casting, or drawing of zinc or zinc-aluminum alloy having the desired composition down to the desired wire size.

The wire may then be fed into the molten bath using a conventional wire feed apparatus, under the molten metal surface where it melts without being exposed to the atmosphere above the galvanizing bath. In this manner, oxidation of the zinc or zinc-aluminum alloy and its dissolved components is avoided, thereby minimizing dross formation by oxidation. Moreover, by avoiding the concentration of aluminum in one small area of the bath, zinc or zinc-aluminum wire additions according to the present invention may also result in less intermetallic dross formation with iron in the bath.

Therefore, the method according to the present invention permits zinc or zinc-aluminum galvanizing bath additions to melt quickly and with the zinc and aluminum constituents going rapidly into solution. Additionally, the rod or wire form used permits the zinc or zinc-aluminum additions to be made deeper into the galvanizing bath. As a result, the method according to the present invention minimizes the amount of time required and facilitates the process of making zinc or zinc-aluminum additions to a galvanizing bath thereby reducing manufacturing times and operating costs. Moreover, by reducing the amount of dross formation, the method according to the present invention increases manufacturing yields and reduces surface defects on plated products.

The present invention will be more readily understood from a consideration of the following illustrative examples. It should be noted that throughout the examples below, the percentages are expressed in terms of weight percent.

The wire of the present invention can consist of from about 10 percent to about 100 percent zinc and from about 0 percent to about 90 percent aluminum. In another embodiment of the present invention, silicon, antimony or lead can also be incorporated into the wire composition.

Two batches of zinc or zinc-aluminum alloy totaling 2,960 pounds were first prepared having a chemistry according to the ASTM B860-95 Standard Specification for Zinc Master Alloys for Use in Hot Dip Galvanizing and set forth below in Table 1:

TABLE 1

| Heat | Aluminum | Magnesium | Copper | Iron | Lead | Cadmium | Tin |
|---|---|---|---|---|---|---|---|
| 1 | 10.1 | <0.001 | 0.035 | 0.008 | 0.0030 | <0.001 | 0.001 |
| 2 | 10.4 | <0.001 | 0.034 | 0.007 | 0.0029 | <0.001 | 0.001 |

EXAMPLE 1

Both batches were ground into Minus 8 mesh powder, extruded into an 8 millimeter diameter wire, and coiled onto a wooden reel. The coiled wire was then fed through a wire feeder and a guide pipe directly into a molten galvanizing bath.

The molten galvanizing bath temperature was 449 degrees Centigrade before the cold wire addition. No detectable temperature drop in the molten bath was noted either during the wire addition or after the wire addition.

The wire feed rate was varied from about 50 feet per minute to about 150 feet per minute where the wire melted in less than one second and appeared to go into solution immediately. Visual observation of the molten galvanizing bath revealed a noticeable reduction in dross upon increasing the wire feed rate from 50 feet per minute to 150 feet per minute. In addition, a noticeable reduction in dross was observed relative to the bulk addition of ingots to the molten bath.

This example indicates that zinc or zinc-aluminum alloy rod or wire may be successfully and quickly dissolved within molten zinc galvanizing baths without premature and undesirable reaction or oxidation. This process also provides for uniform distribution of the reactive elements throughout the resulting alloys. Moreover, it is calculated that a 5000 pound addition using wire according to the present invention (fed using one line feeding at 0.148 pounds/foot×33,700 feet) would require approximately 170 minutes or almost three hours, which would drastically reduce the typical time of sixteen hours needed to make such additions by directly adding ingots in conventional galvanizing baths. The wire of the present invention may also be introduced into molten galvanizing baths by adding multiple wire feed lines either alone or in conjunction with increased wire feed rates to reduce the addition times.

It is also envisioned that zinc and aluminum may be added together in a furnace, melted and alloyed together, cast and formed into a continuous wire (rod), coiled on a spool or in a cage frame and the material fed into the galvanizing bath as per Example 1.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

While embodiments and applications of this invention have been shown and described, it will be apparent to those skilled in the art that many more modifications are possible without departing from the inventive concepts herein described. For example, although the method according to the present invention is described as utilizing a solid rod or wire of a zinc or zinc-aluminum alloy of a specific chemistry, it is envisioned that the wire may be provided in varying percentages of the zinc and aluminum components, either alone or with other additional chemical components.

It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A method for adding zinc, or a zinc-aluminum alloy to a molten metal galvanizing bath for galvanizing iron and iron-based alloys comprising:

(a) providing a molten mass of metal selected from the group consisting of zinc, aluminum, zinc-based alloys, and aluminum-based alloys;

(b) providing a zinc or zinc-aluminum alloy wire having a cross-section of from about 8 millimeters to about 25 millimeters;

(c) adding the wire into the molten metal mass wherein the zinc or zinc-aluminum alloy wire is continuously fed directly into the molten mass at a rate of from about 50 feet per minute to about 1000 feet per minute to enable dissolution and uniform distribution of the zinc or zinc-aluminum based alloy throughout the entire molten metal mass.

2. The method according to claim 1, wherein the zinc-aluminum alloy wire is a zinc-based alloy.

3. The method according to claim 1, the zinc-aluminum alloy wire is an aluminum-based alloy.

4. The method according to claim 1, wherein the zinc-aluminum alloy wire comprises about 10–100 weight percent zinc and about 0–90 weight percent aluminum.

5. The method according to claim 1, wherein the zinc-aluminum alloy wire comprises about 90 weight percent zinc and about 10 weight percent aluminum.

6. The method according to claim 1, wherein the zinc-aluminum alloy wire comprises about 95 weight percent zinc and about 5 weight percent aluminum.

7. The method according to claim 1, wherein the zinc-aluminum alloy wire comprises about 85 weight percent zinc and about 15 weight percent aluminum.

8. The method according to claim 1, wherein the zinc or zinc-aluminum alloy wire is continuously fed into the molten mass at a rate of about 150 feet per minute.

9. The method according to claim 1, wherein the zinc or zinc-aluminum based alloy wire has a cross-section of about 10 millimeters.

* * * * *